US011749081B2

(12) United States Patent
Rutter et al.

(10) Patent No.: US 11,749,081 B2
(45) Date of Patent: Sep. 5, 2023

(54) CONTROL SYSTEM

(71) Applicant: Fireangel Safety Technology Limited, Coventry (GB)

(72) Inventors: Nicholas Rutter, Barford (GB); Chris Bolger, Warwickshire (GB)

(73) Assignee: Fireangel Safety Technology Limited, Coventry (GB)

( * ) Notice: Subject to any disclaimer, the term of this patent is extended or adjusted under 35 U.S.C. 154(b) by 17 days.

(21) Appl. No.: 17/298,243

(22) PCT Filed: Dec. 3, 2019

(86) PCT No.: PCT/GB2019/053417

§ 371 (c)(1),
(2) Date: May 28, 2021

(87) PCT Pub. No.: WO2020/115472

PCT Pub. Date: Jun. 11, 2020

(65) Prior Publication Data

US 2022/0114872 A1 Apr. 14, 2022

(30) Foreign Application Priority Data

Dec. 3, 2018 (GB) ..... 1819719

(51) Int. Cl.

| | |
|---|---|
| ***G08B 17/10*** | (2006.01) |
| ***G08B 17/06*** | (2006.01) |
| ***G08B 25/00*** | (2006.01) |

(52) U.S. Cl.

CPC ..... *G08B 17/10* (2013.01); *G08B 17/06* (2013.01); *G08B 25/001* (2013.01); *G08B 25/008* (2013.01)

(58) Field of Classification Search

CPC ..... G08B 17/10; G08B 17/06; G08B 25/001; G08B 25/008; G08B 17/00; G08B 25/009; G08B 17/117

See application file for complete search history.

(56) References Cited

U.S. PATENT DOCUMENTS 5,428,341 A * 6/1995 Takahashi ..... G08B 17/00 340/505
6,346,880 B1 * 2/2002 Schroeder ..... G08B 29/145 340/506

(Continued)

OTHER PUBLICATIONS

International Search Report issued by ISA/EPO in connection with PCT/GB2019/053417 dated Mar. 16, 2020.

(Continued)

*Primary Examiner* — Ojiako K Nwugo
(74) *Attorney, Agent, or Firm* — Levenfeld Pearlstein, LLC

(57) ABSTRACT

A control system for silencing an alarm signal of an alarm device comprises a sensor to receive the alarm signal, an input interface for an operator instruction to silence the alarm signal, and control logic to silence the alarm signal. The control logic determines if the alarm signal exceeds a signal threshold indicative of the proximity of the alarm device. If the signal threshold is not exceeded, the control logic prevents the silencing of the alarm device. The control system provides a silencing mechanism that allows remote actuation while requiring a user to be close enough to the alarm device.

26 Claims, 5 Drawing Sheets

(56) References Cited

U.S. PATENT DOCUMENTS

| | | | | |
|---|---|---|---|---|
| 9,640,061 | B1 | 5/2017 | Klimanis et al. | |
| 2005/0148890 | A1* | 7/2005 | Hastings | G16H 40/67 600/509 |
| 2007/0080819 | A1 | 4/2007 | Marks et al. | |
| 2011/0025499 | A1* | 2/2011 | Hoy | G08B 3/10 340/540 |
| 2012/0081230 | A1* | 4/2012 | Sullivan | G08B 3/10 340/636.1 |
| 2016/0364114 | A1 | 12/2016 | Von Dehsen et al. | |
| 2017/0193805 | A1 | 7/2017 | Stagg et al. | |

OTHER PUBLICATIONS

International Preliminary Report on Patentability issued by ISA/EPO in connection with PCT/GB2019/053417 dated Jun. 8, 2021.
Search Report Under Section 17(5) issued by UKIPO in connection with GB1819719.4 dated Jun. 4, 2019.

* cited by examiner

CONTROL SYSTEM

CROSS-REFERENCE TO RELATED APPLICATION DATA

This application is a 35 U.S.C. 371 U.S. national stage filing of International Application No. PCT/GB2019/053417, having an international filing date of 3 Dec. 2019, which claims the benefit of and priority to Great Britain Application GB 1819719.4, having a filing date of 3 Dec. 2018, the disclosures of which are incorporated herein in their entireties.

FIELD OF THE INVENTION

The present invention relates to control system and method for facilitating the control an alarm device. More particularly, the present invention relates to a safeguard mechanism ensuring remote deactivation of an alarm signal is only permitted under defined circumstances.

BACKGROUND

Alarm devices, such as heat sensors, smoke detectors or carbon monoxide detectors, are configured to emit an alarm signal indicative of an alarm condition such as heat, smoke, or carbon monoxide concentration. The alarm signal may be indicative of a true alarm condition or may be a false alert. In either case, it may be desirable to stop the alarm signal. To this end, alarm devices include a silencing button allowing the alarm signal emitted from the alarm device to be deactivated, e.g. to allow a sound signal to be silenced. Actuation of the silencing button deactivates the alarm signal and typically the alarm device continues to monitor the environment for the presence of an alarm condition.

Such silencing buttons are located on the alarm device, which helps to ensure that a person deactivating the alarm signal is present at the alarm device, which provides certain reassurance that the person deactivating the alarm was able to verify that it is safe to do so, e.g. because the alarm condition is not or no longer present. Indeed it is a regulatory requirement in some jurisdictions that at least a test button for an alarm device must be located on the very alarm device.

International Patent Application No. PCT/GB2014/052564 by the present applicant discloses a button that faces down (when the alarm device is installed on a ceiling) to allow the button at ceiling level to be operated with an aid such as a walking stick. The same patent application also discloses a button configuration with a dished (concave) surface to reduce the risk of a stick end sliding off the button while an attempt is made to depress the button.

The present invention seeks to further improve known arrangements.

SUMMARY OF THE INVENTION

In accordance with a first aspect of the present invention, there is provided a control system for silencing an alarm signal from an alarm device, as defined in claim 1.

The control system comprises a sensor configured to receive an alarm signal from an alarm device, an input interface configured to receive an operator instruction to silence the alarm signal, and control logic configured to issue in response to the operator instruction a silencing instruction interpretable by the alarm device as an instruction to deactivate the alarm signal. The control logic is configured to determine whether or not the alarm signal exceeds a signal threshold indicative of the proximity of the input interface to the alarm device. Optionally, the control logic is configured to determine whether or not at least one of the operator instruction and the alarm signal exceeds a signal threshold indicative of the proximity of the input interface to at least one of the operator and the alarm device. The control logic includes an interlock preventing the silencing instruction from being sent for the alarm device if the signal threshold is not exceeded.

The control system, or controller, may be provided by a software application, for instance for a hand-held device such as a smartphone or a tablet, or for a stationary control device such as a connected device (e.g. an internet connected or "cloud" connected digital assistant), including a configuration to use the device's microphone as a sensor for the alarm and to use speech input or contact input as input interface for the operator instruction.

If, upon noticing an alarm signal, a user wishes to silence the alarm device, the control system can be used to send a silencing instruction to the alarm device, or to a server that will issue a silencing instruction to the alarm device.

However, if a user is not present at the alarm, then this risks a user remotely deactivating an alarm when it is inappropriate to do so. The present invention provides reassurance of a proximity condition being fulfilled, namely that the silencing instruction is sent to an alarm device only if the user intending to silence an alarm is sufficiently close to do so.

The present invention was derived from the appreciation that a remote silencing feature may be used inappropriately. To provide examples, one scenario of concern is the presence of a real alarm condition after one or more false alerts, during which a user may be tempted to remotely silence the alarm. Another scenario of concern is the silencing of an alarm by an unauthorised user. Another scenario is the accidental silencing of the wrong alarm device where two or more alarm devices are located relatively close to each other.

The reassurance of a proximity condition being fulfilled is provided by the configuration of the control logic to make a determination whether or not the alarm signal is above a signal threshold. E.g., for an audio alarm the control logic may determine whether the alarm sound is loud enough to indicate that the control system is close to the alarm device or whether the alarm sound is too quiet, indicating that the control system is too far from the alarm device.

In some embodiments, the control logic is configured to classify the alarm signal based on at least one of the volume, frequency and modulation of the alarm signal.

The alarm signal may be classified for identification purposes and/or for verification purposes. The control logic may compare the alarm signal with a database of known alarm signals and of known alarm behaviour of alarm devices. This allows the alarm signal to be verified. For instance, the control logic may determine from the frequency and modulation of the alarm signal that the alarm signal is generated by a particular type of alarm device with a device-specific alarm volume, e.g. of 85 dB. Thereby, the control logic may set a signal threshold that is alarm-specific, e.g. device-specific and/or signal-specific. The control logic may compare the alarm signal with a database of known signals allowing it to distinguish between alarm signals and other signals issued by the alarm device.

Regulations are in place that require alarm signals to be loud enough, i.e. above a signal threshold, at a certain distance from the alarm device, for instance to exceed 85 dB at 3 metres distance from a sounding alarm device. As such, a less loud alarm signal can be assumed to originate from a device further than the certain distance (e.g. 3 metres). The invention is based in part on the appreciation that, typically, line-of-sight proximity to the alarm device can be assumed when the signal strength is above the signal threshold.

In some embodiments, the input interface and the sensor are comprised in a handheld device or a non-handheld/stationary device.

The handheld device may be a bespoke control device, or a device such as a remote control device, a portable computer or mobile phone, or a smart-home control device such as a digital assistant device or speaker, that has been provided with functionality of the invention by way of a programme (or "app"). The device may be battery powered and/or mains powered. For instance, typical modern smart phones are capable of providing a sound-detecting function while in a low-power consumption mode. Modern internet-connected digital assistants, which are typically mains-powered, are capable to continuously listen for sound inputs. Such devices may be programmed, e.g. with an application or "app", to continuously listen for an alarm signal and to activate an input interface when an alarm signal is detected.

The input interface may be provided as a software application with a suitable hand-held device such as a mobile phone or an audio-enabled remote control.

In some embodiments, the input interface comprises a touch screen.

In some embodiments, the input interface comprises a remote control interface.

The input interface may be a button, i.e. either a physical button permanently or temporarily assigned a silencing function, or a touch screen interface. The input interface may be controllable remotely, e.g. utilise voice recognition, voice activation or recognition of gestures or facial expressions.

The input interface may be presented automatically upon recognition of an alarm signal. A smart device may be provided with a functionality allowing it to activate the screen of another device, e.g. of a tablet computer or a television screen, to present options to a user.

In some embodiments, the control system is configured to present a notification when the control logic determines that the signal threshold is not exceeded by the alarm signal, or by at least one of the operator instruction and the alarm signal.

The notification may be provided to confirm that an operator instruction to silence the alarm has been received and to notify the user that the instruction is not carried out. The notification may include status message. The status message may state that an operator instruction has been received but no alarm signal is being detected by the sensor.

In some embodiments, the control system is configured to present a notification when the control logic determines the presence of an alarm signal and the signal threshold is not exceeded by the alarm signal, or by at least one of the operator instruction and the alarm signal.

The status message may confirm that one or more alarm signals have been detected. The status message may state that the alarm signal is below the alarm threshold. The status message may suggest a remedial action, e.g. instructing the user to move, together with the remote control device if appropriate, closer to the alarm device, or to one of the alarm devices.

In some embodiments, the control system is configured to present the silencing instruction via a wireless communication channel.

The control system may use a suitable communication channel, such as wireless network access, Bluetooth, or similar. Alternatively or concurrently, the control system may be configured to use a wired communication channel. This may be suitable for stationary devices including a control system, such as networked smart home appliances.

In some embodiments, the control system is configured to present the silencing instruction to an intermediary other than the alarm device.

The intermediary may be a server or multi-server system (e.g. a "cloud"). The intermediary may be a hub such as a control panel or other suitable system.

The intermediary may log the occurrence of alarm events, including the detection of alarm events, silencing events etc for one or more alarm devices.

In some embodiments, the control system comprises a server, at least one alarm device in communication with the server, and a control device comprising the sensor, wherein the control logic is configured to issue the silencing instruction to the server.

In some embodiments, the control system is configured to execute the control logic on the control device.

In some embodiments, the control system is configured to execute the control logic on the server.

Part or all of the control logic may be executed on the control device or on the server.

The control logic may be executable on both the control device or on the server.

In embodiments, the control logic is configured to distinguish between a detector alarm device that has detected an alarm condition and a repeater alarm device that sounds an alarm signal without having detected the alarm condition, and wherein the control logic includes a configuration allowing it to prevent a silencing instruction from being sent for a detector alarm device.

It is increasingly common for alarm devices to be operatively connected, to operate as part of a network, e.g. a home network. In such a network, one or more, or all alarm devices are capable of detecting an alarm condition. Some or all of the devices are capable of repeating and/or relaying an alarm signal, by which is meant that the alarm device has not itself detected the alarm condition, but receives an alarm code from a server or other alarm device to issue an alarm signal.

For instance, an installation in a building may comprise alarm devices in different rooms, such as a kitchen, garage, and living room. The alarm device in the kitchen may detect an alarm condition that is unnoticed by the alarm devices in the garage and living room. Upon detection of an alarm condition by the kitchen alarm device, the other alarm devices may be activated, such that all alarm devices may sound an alarm.

An alarm device that detected the alarm condition is herein referred to as a detector alarm device. An alarm device that issues an alarm signal without having detected an alarm condition is herein referred to as a repeater alarm device, whether or not the repeater alarm device is capable of detecting an alarm condition. A detector alarm device and a repeater alarm device may be the same type of device or may be different device types. For instance, an alarm device in a garage may be a carbon monoxide detector and an alarm device in a kitchen may be a heat detector.

By being able to prevent a silencing instruction from being sent for detector alarm device, the control system is able to issue silencing instructions only to repeater alarm devices. Silencing all alarm-sounding devices that have not detected an alarm condition provides a locating functionality: once executed, only the one or more alarm devices that detected the alarm event continue to sound an alarm.

In some embodiments, the control system comprises a configuration to send a silencing instruction for the detector alarm device if the repeater alarm devices have been silenced.

The control system may comprise a configuration allowing it to determine whether or not the repeater alarm devices have been silenced. In that case, alarm devices still sounding an alarm may be assumed to be detector alarm devices.

The interlock of the invention continues to operate to prevent a user from silencing an alarm unless a proximity condition is fulfilled. For the user, locating the detector alarm device is facilitated once it is the only alarm-sounding device (or once there are only few sounding devices). The use can move closer to the detector alarm and, if appropriate, silence the detector alarm.

In accordance with a second aspect of the present invention, there is provided a method for controlling the silencing of an alarm signal of an alarm device, as defined in claim 15.

The method comprises the steps of using a sensor to receive an alarm signal from the alarm device, using an input interface to receive an operator instruction to silence the alarm signal, providing control logic configured to issue a silencing instruction to deactivate the alarm signal in response to the operator instruction, making a determination whether or not the alarm signal exceeds a signal threshold indicative of the proximity of the input interface to the alarm device, and blocking the silencing instruction from being sent for the alarm device if the signal threshold is not exceeded.

Optionally, the method comprises making a determination whether or not at least one of the operator instruction and the alarm signal exceeds a signal threshold indicative of the proximity of the input interface to at least one of the operator and the alarm device.

In some embodiments, the method comprises permitting the silencing instruction to be sent to the alarm device if both the operator instruction and the alarm signal fulfil a proximity condition.

In some embodiments, the method comprises verifying the alarm signal based on at least one of the volume, frequency and modulation of the alarm signal.

In some embodiments, the method comprises presenting a message when the control logic determines that the signal threshold is not exceeded by the alarm signal, or by at least one of the operator instruction and the alarm signal.

In some embodiments, the method comprises sending the silencing instruction via a wireless communication channel.

In some embodiments, the method comprises sending the silencing instruction to a device other than the alarm device, in particular to a server in communication with the alarm device.

In some embodiments, the method comprises distinguishing between a detector alarm device that has detected an alarm condition and a repeater alarm device that sounds an alarm signal without having detected the alarm condition, and prevent a silencing instruction from being sent for a detector alarm device.

In some embodiments, the method comprises sending a silencing instruction for the detector alarm device if the repeater alarm devices have been silenced.

The method and/or the control logic may be embodied in the form of software instructions. The control system may comprise a processor and software instructions implemented by the processor.

The embodiments of the second aspect may be combined with embodiments of the first aspect. For instance, and method step of the second aspect may be provided as a configuration of a device used in the first aspect. Likewise, and configuration disclosed in the first aspect may be carried out by a corresponding step in the second aspect.

DESCRIPTION OF THE FIGURES

Exemplary embodiments of the invention will now be described with reference to the Figures, in which.

DESCRIPTION

Figure 1:
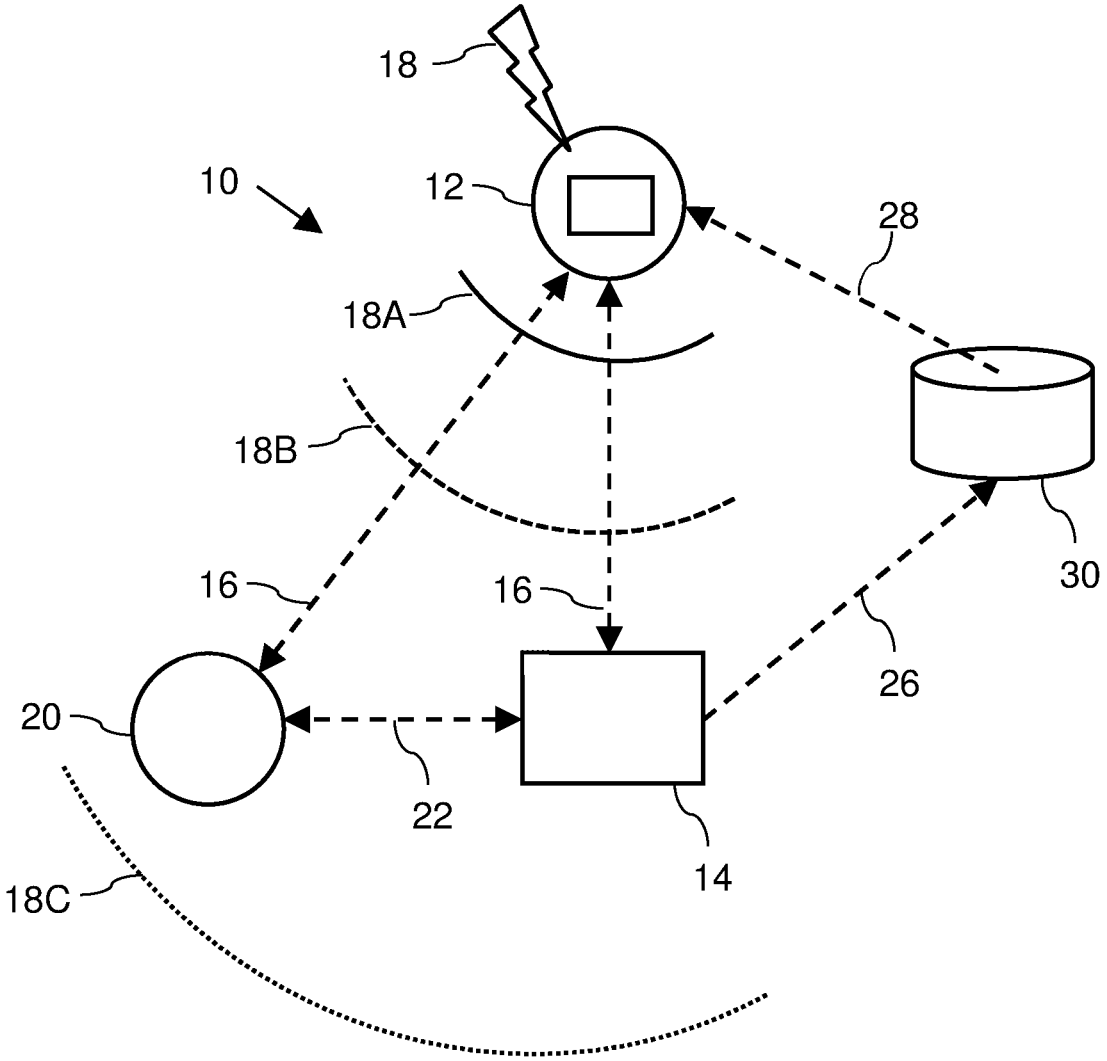
FIG. 1 shows an exemplary embodiment operating in a first set of circumstances.

FIG. 1 shows a control system 10 for silencing an alarm signal 18 from an alarm device 12. The alarm device 12 may be a heat alarm, smoke alarm, carbon monoxide alarm or the like and may be installed in a domestic dwelling. The control system 10 comprises an input interface 14 for use by an operator 20 or end user. The alarm device 12 is a spaced a distance 16 from the input interface 14, and, likewise, the operator 20 is remote by a distance 16 from the alarm device 12. The input interface 14 is configured to receive an operator instruction 22 from the operator 20.

The input interface 14 comprises a sensor (not shown in FIG. 1) configured to receive an alarm signal 18 from the alarm device 12, such as a microphone and software instructions, processor and memory to evaluate signals received by the microphone. When the alarm device 12 is emitting an alarm signal 18, it can be imagined that the alarm signal 18 decreases in signal strength with increasing distance from the alarm device 12. For instance, as illustrated in FIG. 1, the alarm signal 18 may have a high signal strength 18A closest to the alarm device 12, a medium signal strength 18B further away from the alarm device 12 and a low signal strength 18C further away from the alarm device 12.

The control system comprises a server 30, although it will be appreciated that embodiments of the invention may not require a server. The control system 10 comprises an interface channel 26 for communication between the input interface 14 and the server 30. The control system 10 comprises an alarm device channel 28 for communication between the server 30 and the alarm device 12. In control systems without server, the communication may be directly between the input interface 14 and one or more alarm devices 12. The server 30 may be constituted by one or more alarm devices (see e.g. FIGS. 3 and 4).

In some arrangements, the alarm device 12 may be configured to transmit an alert signal. The alert signal may be indicative that the alarm device 12 is emitting the alarm signal 18. The alert signal may control the sensor to begin listening for alarm signals from the alarm device 12. The alarm device 12 may be configured to transmit the alert signal on detection of an alarm condition. For example, the alarm device 12 may transmit the alert signal if the alarm device 12 detects a threshold heat, smoke or carbon monoxide concentration.

In exemplary arrangements, the alarm device may be configured to transmit the alert signal to the server 30. The server 30 may be a remote server, such as a cloud server. The server 30 may receive the alert signal and transmit the alert signal (or a signal indicative of receipt of the alert signal) to the input interface 14. In alternative arrangements, the alert signal may be transmitted by the alarm device 12 directly to the input interface 14.

The input interface 14 may control the sensor to detect alarm signals from the alarm device 12 on receipt of the alert signal. As described below, the input interface 14 may be provided in the form of a hand-held/control device, or in the form of a software application for use on a hand-held/control device. In such arrangements, the hand-held or control device may receive the alert signal and control the sensor to monitor for alarm signals. In such arrangements, the sensor may be configured to receive the alarm signal 18 after or upon receipt of the alert signal by the input interface 14 and/or hand-held or control device.

The alert signal sent to the input interface 14 may allow the input interface 14 to notify the operator 20 that the alarm device 12 is emitting the alarm signal 18. This may be particularly useful, for example, in situations where the distance 16 is too great for the operator 20 or the sensor of the input interface 14 to detect the alarm signal 18 (i.e. when the operator 20 and/or the input interface 14 are further away from the alarm device 12 than the low signal strength 18C).

The control system 10 comprises control logic to determine whether an operator instruction 22 and/or an alarm signal 18 received at the input interface 14 exceeds a signal threshold. The signal threshold may be selected corresponding to an expected volume of the alarm signal 18 at a given distance from the alarm device 12. For instance, for a given alarm device 12, the sounder may be configured to emit an alarm at a standardised volume of 95 dB at the alarm device 12. For instance, the volume at the alarm device may be set to 95 dB in order to achieve that a level of 85 dB can be ensured at 3 metres distance from the alarm device 12. The signal threshold may be set at a level of 85 dB and the control logic may be configured to determine that a proximity condition is fulfilled if the alarm signal is received at the input interface with a strength of more than the signal threshold. Conversely, if in the example the alarm signal is received with a strength lower than the threshold, e.g. 65 dB, the control logic may determine that a proximity condition is not fulfilled.

The use of the alarm signal volume as indicator for a proximity condition is derived from the appreciation that alarm devices emit a standardised signal, in particular a signal that is volume standardised, for instance requiring a certain minimum strength at a given distance from an alarm device. The use of alarm signal volume as an indicator for a proximity condition is also advantageous in that no additional or potentially expensive hardware is required to be added to the standard alarm device.

It will be appreciated that the input interface 14 may be standardised to ensure a certain volume, as received by the input interface 14, corresponds to an expected signal strength. For instance, if carried out in software, the software may comprise a look-up table for different types of mobile device (such as mobile phones, tablets, or wearable devices such as smart watches) or for different types of smart home devices (such as internet-connected digital home assistants).

The decreasing signal strength is illustrated in FIG. 1 by conceptual isolines for high signal strength 18A, medium signal strength 18B and low signal strength 16C. The signal threshold may be set to the low signal strength 18C, meaning that a signal with a strength less than the low signal strength 18C is characterised by the control logic as failing to fulfil the proximity condition.

In FIG. 1, the alarm device 12 emits an alarm signal 18. The operator 20 notices the alarm signal 18 and is in a position to deactivate the alarm signal 18. The operator 20 could be in a position to deactivate the alarm signal 18 because the alarm condition is no longer relevant or because a false alarm condition was recognised. The operator 20 sends an operator instruction 22 to the input interface 14 in order to silence the alarm device 12.

Upon receiving the operator instruction 22, the control logic makes a determination whether or not the input interface 14 is sufficiently close to the alarm device 12 so that it can be assumed that the operator 20 was qualified to determine the silencing instruction is appropriate. In FIG. 1, the input interface 14 is close enough to the alarm device 12 for it to be ensured that the alarm signal is received by the sensor of the input interface 14 has a signal strength exceeding the alarm threshold (indicated by the low signal strength 18C).

The control logic determines that a silencing instruction was received at the input interface 14 and that the proximity condition is fulfilled by virtue of the alarm signal exceeding the signal threshold. The control logic relays a silencing instruction via the interface channel 26 to the server 30. The server 30 issues a silencing instruction via the alarm device channel 28 to the alarm device 12. The alarm signal 18 is deactivated and the alarm device 12 continues to monitor for the presence of an alarm condition.

Figure 2:
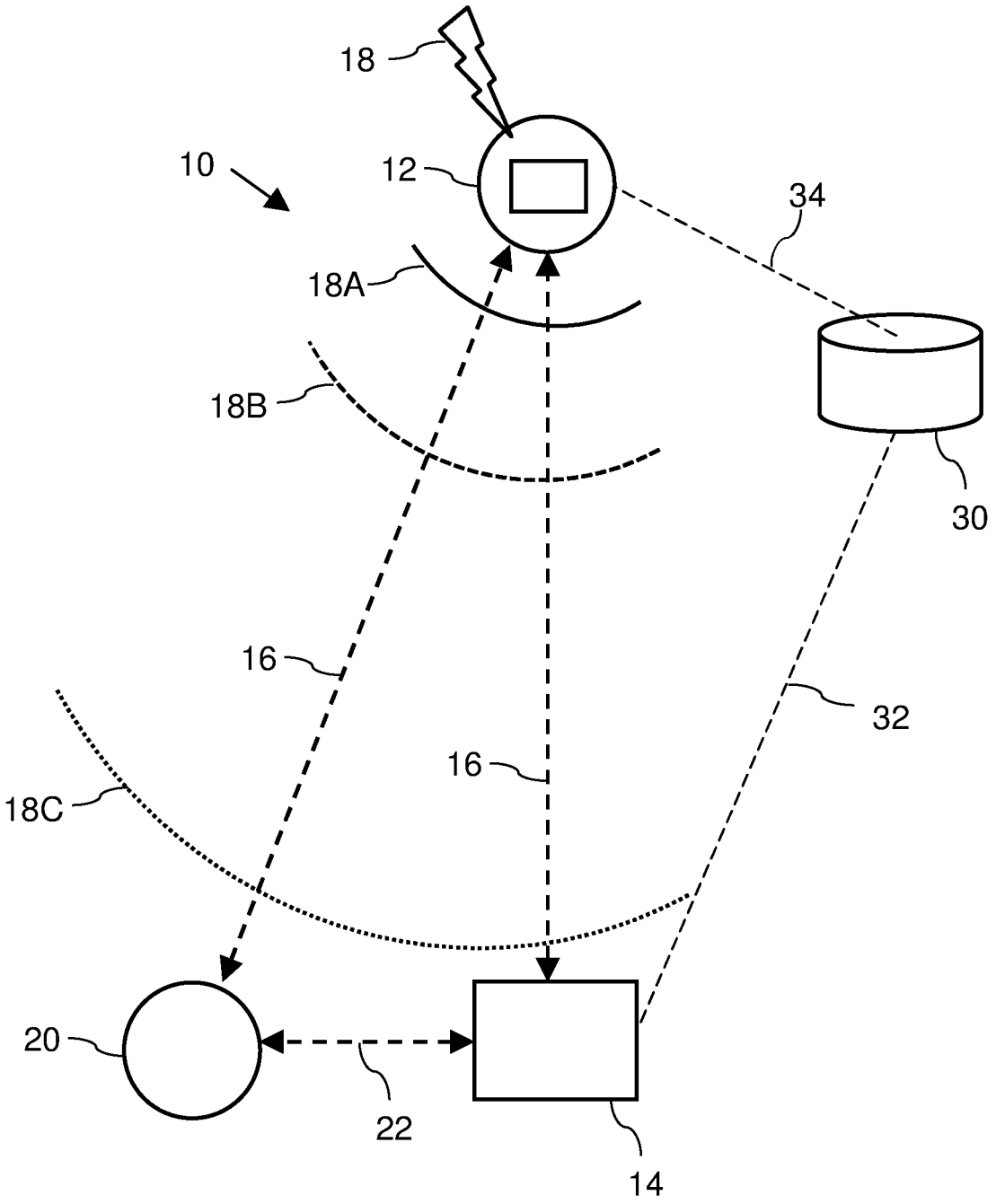
FIG. 2 shows an exemplary embodiment operating in a second set of circumstances.

In FIG. 2, the same control system 10 is shown as in FIG. 1, although in different circumstances. The same numerals are used in FIG. 2 for corresponding elements in FIG. 1. For brevity, the description of the same or corresponding elements is not repeated.

In FIG. 2, the operator 20 and the input interface 14 are further away from the alarm device 12 than in FIG. 1. In particular, these are outside, i.e. further from the alarm device 12 than, the signal threshold indicated by the low signal strength 18C, and so an alarm signal 18 received at the sensor of the input interface 14 fails to fulfil the proximity condition. The operator 20 may not be aware the proximity condition is not fulfilled. Nevertheless, the operator 20 may hear the alarm signal 18 and may wish to silence the alarm. The operator 20 sends an operator instruction 22 to the input interface 14 in order to silence the alarm device 12.

Upon receiving the operator instruction 22, the control logic makes a determination that the input interface 14 is not sufficiently close to the alarm device 12, because it is below the signal threshold corresponding to the low signal strength 18C, and so there is a risk the operator 20 was not able to determine the silencing instruction is appropriate for the particular alarm device 12.

The control logic therefore prevents a silencing instruction from being sent for the alarm device 12, e.g. no silencing instruction is sent to the server 30 and/or to the alarm device 12. The blocking of a silencing instruction may be implemented by way of an interface interlock 32 or by way of a server interlock 34. Optionally, the control system 10 may issue a notification to the operator 20 that an operator instruction was received and that an alarm signal is being sensed, but that the alarm signal strength is below the signal strength. For instance, the control system 10 may instruct the operator 20 to move closer to the alarm device 12 to thereby fulfil the proximity condition. The control system may include a configuration to continue to operate until the alarm signal 18 has been silenced. The alarm signal 18 may be silenced by the control system once a proximity condition is fulfilled. The alarm signal may have been silenced by another person authorised to silence the alarm signal 18.

FIGS. 1 and 2 illustrate scenarios that may be observed for a user carrying a portable device with the input interface 14. The input interface 14 may be provided in the form of a hand-held device, or in the form of a software application for use on a portable device. For instance, the input interface may be provided as a software application for a mobile phone, smart watch, or other suitable wearable device. The operator instruction may be entered into the input interface by physical contact, e.g. by pressing a button on the input interface or by operating a touch screen on the input interface.

Figure 3:
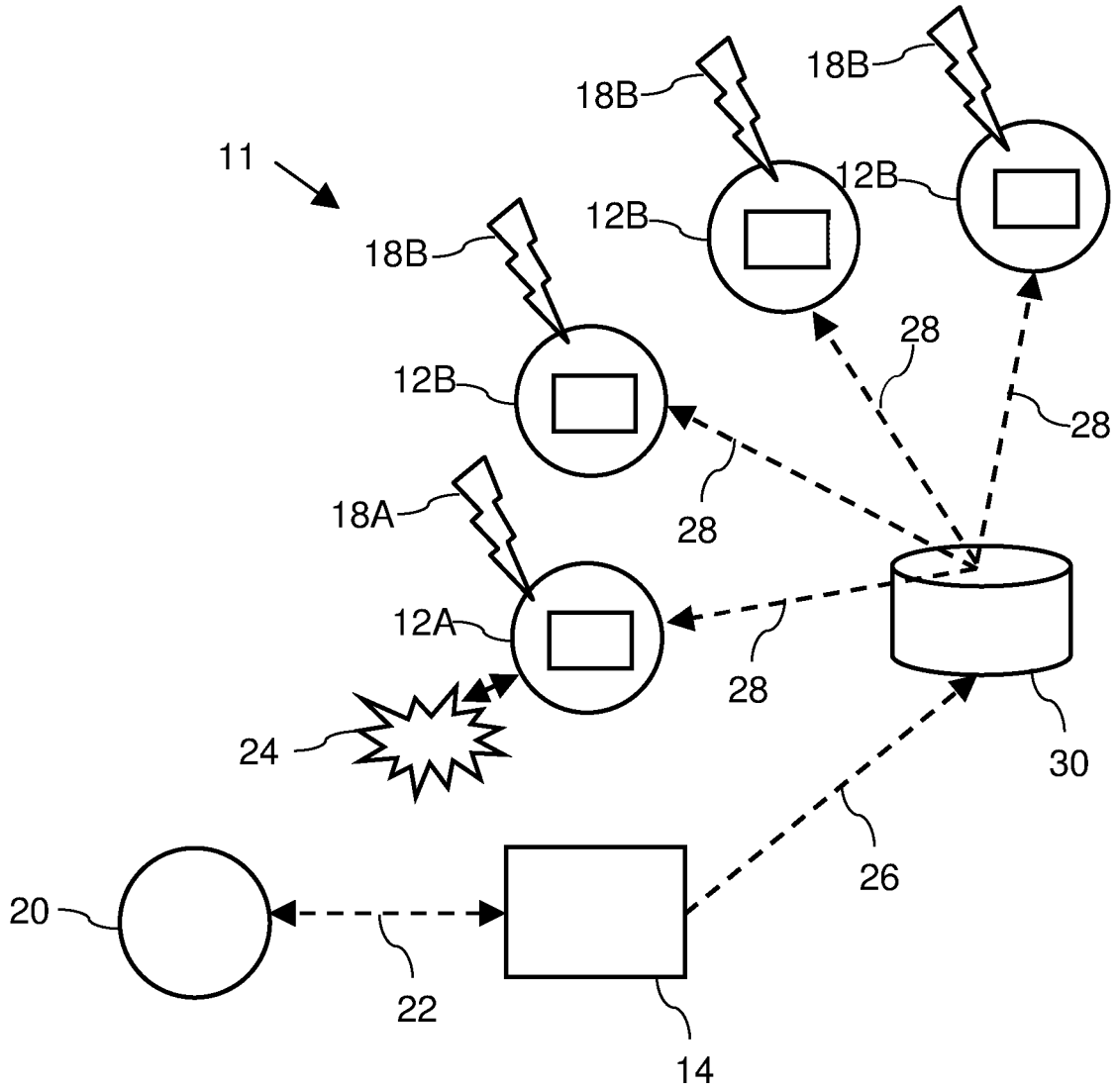
FIG. 3 shows an exemplary embodiment operating in a third set of circumstances.
Figure 4:
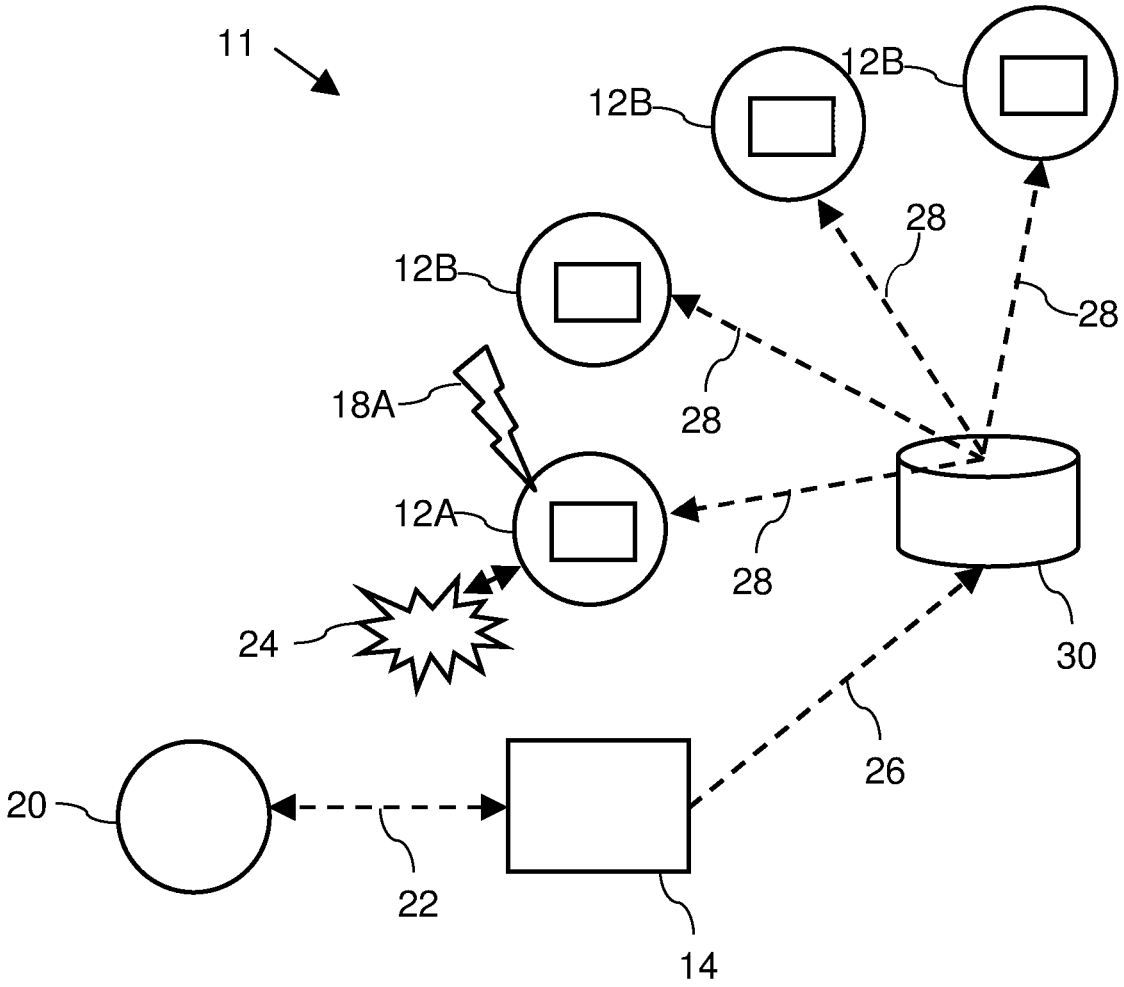
FIG. 4 shows an exemplary embodiment operating in a fourth set of circumstances.

FIGS. 3 and 4 show a control system 11 in which a plurality of (here: four) alarm devices 12A, 12B are in communication with a server 30. The alarm devices may be located in different rooms and may be part of a connected alarm system. It will be understood that the server 30 may be optional and the alarm devices may be corresponding directly with each other. The server 30 may be constituted by one or more of the alarm devices 12A, 12B.

In FIG. 3, all alarm devices 12A, 12B are monitoring for the presence of an alarm condition 24. One of the alarm devices constitutes a detector alarm device 12A that has detected the presence of the alarm condition 24 and issues an alarm signal 18A. The other alarm devices are repeater alarm devices 12B that did not directly detect the alarm condition 24 but have been activated to sound an alarm signal 18B. For instance, the detector alarm device 12A may have issued an alarm code to the server 30 and/or to one or more of the repeater alarm devices 12B.

The sounding of multiple alarm devices 12A, 12B is a feature that increases the likelihood of a user noticing the alarm signal. The input interface 14 may detect the presence of an alarm signal 18A and/or 18B or may be notified by an alarm device 12A, 12B and/or server 30 that an alarm condition 24 has been detected.

The input interface 14 may present a menu option to locate the detector alarm device 12A. The operator may issue an operator instruction 22 to the input interface 14 to locate the detector alarm device 12A. In that case, a silencing instruction may be issued via the interface channel 26 to the server 30. The control logic may issue a silencing instruction 28 only for repeater alarm devices 12B. The silencing instruction may be an identical command sent to each alarm device 12A, 12B that is interpreted differently by each alarm device 12A, 12B depending on whether or not it is a detector alarm device. The silencing instruction may be a different command for the detector alarm device 12A and for the repeater alarm device 12B. The silencing instruction may be sent only to repeater alarm devices 12B.

In FIG. 4, all the alarm signals 18B from all repeater alarm devices 12B have been silenced. Only the alarm signal 18A from detector alarm device 18A continues to sound. It will be understood that one or more alarm devices may have detected an alarm condition contemporaneously and so there may be one or more detector alarm devices sounding an alarm signal after execution of location procedure. In the example of FIG. 4, only the detector alarm device 12A continues to sound an alarm signal 18A, locating the remaining alarm-sounding device 12A is facilitated for the operator 20.

The input interface 14 may continue to be active to receive an operator instruction 22, as set out in relation to FIGS. 1 and 2. Once the proximity condition is fulfilled in relation to the detector alarm device 12A, a silencing instruction 22 by the operator 20 deactivates the alarm signal 18A.

The input interface 14 may be designed with only a few menu choices, such as touch screen fields (buttons), to facilitate the handling of what might be a stressful situation for the operator 20. For instance, in one embodiment it is envisaged that the input interface 14 includes no more than two buttons presented at the same time, or no more than three buttons at the same time. One button may be to locate an alarm and one button may be to escalate, e.g. to make an emergency call or notify a warden, such that there are only two menu choices (a locate-alarm button and an escalate button). If the operator 20 is certain an alarm condition is real, the escalate button of the input interface 14 allows the operator to immediately make an emergency call. A menu option to escalate may cause the input device to directly connect to a 999 number or appropriate services. Alternatively, if the operator 20 wishes to first investigate the alarm condition, actuating the locate-alarm button allows all repeater alarm devices 12B that are not detector alarm devices 12A to be silenced. The input interface may then change (as may be imagined is easy to implement for an interactive touch screen) to replace the locate-alarm button with a silence-alarm button, such that only two menu choices are presented (a silence-alarm button and an escalate button). Once the operator 20 is close enough to the detector alarm device 12A to fulfil the proximity condition, the detector alarm device 12A may be silenced. As set out above, if the operator 20 executes the silencing instruction but fails to fulfil a proximity condition, a notification may be presented that the operator 20 needs to move closer to the detector alarm device 12A.

Figure 5:
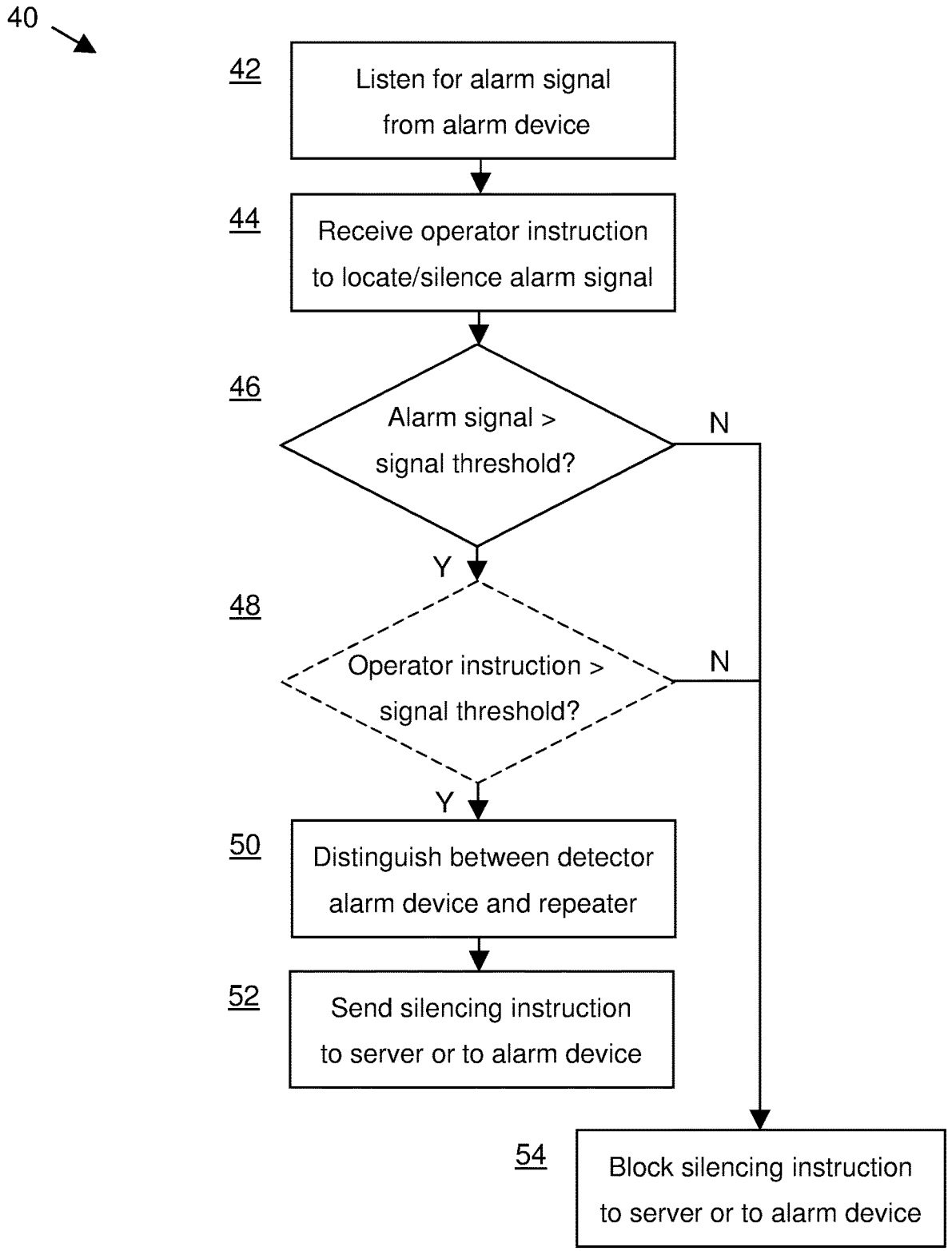
FIG. 5 shows exemplary steps of a method in accordance with the invention.

FIG. 5 shows steps of a control method 40. In step 42, the control system listens for the presence of an alarm signal received from an alarm device. The control system may start to listen upon a user instruction. The control system may be continuously listening, as may be the case for a smart home appliance awaiting a voice command, or a mobile device being in background listening mode.

Alternatively, in some arrangements, the control system may listen for the presence of an alarm signal in response to the input interface (or control device) receiving an alert signal from the alarm device 12. For example, as described above, the alert signal may be transmitted by the alarm device 12 to the input interface 14, either directly or via other entities such as the server 30.

The alarm signal may be received by the control system via a sensor such as the microphone of a mobile phone, of a voice-activated remote control, or of a smart home appliance. In a further optional step (not shown in FIG. 5), the control system may activate an input interface. This further optional step may be in response to the receipt of the alert signal by the input interface. The input interface may include a silence-alarm button, a locate-alarm button, an escalate button, or similar. For instance, the control system may present a silencing screen with an input field on a touch screen. For instance, the control system may create an audio message "Say 'Device silence' to turn off the alarm".

In step 44, an operator instruction is received to locate and/or silence the alarm signal. The control system moves to either step 46 to optional step 48, or may be configured to move first to step 50. In step 46, a determination is made whether or not the alarm signal exceeds a pre-determined signal threshold. The pre-determined threshold may be determined by the control logic by comparing the alarm signal to a database to identify a device-specific alarm pattern and deriving a suitable or device-specific signal threshold. The pre-determined threshold may be determined by comparing the signal as received by the input interface to a lookup table.

If, in step 46, the determination yields that the alarm signal is below the signal threshold, then the control logic executes step 54 to block a silencing instruction to the alarm. Depending on the configuration the control system may not send a silencing instruction to an alarm device or server, or the control system may send an instruction to the server for the server not to send a silencing instruction to the alarm device in question.

If, in step 46, a determination yields that the alarm signal exceeds the signal threshold, this is indicative of the proximity requirement being fulfilled by the alarm signal. The control system may execute an optional step 48 in which a determination is made whether or not the operator instruction exceeds a signal threshold. Step 48 may be optional; for instance for a touch-screen input the operator proximity may be fulfilled by the operator touching the screen. Step 48 may be appropriate for a voice command input. Step 48 may be omitted in practice by assuming that an operator is close enough if the operator instruction is received by the input interface.

If, in step 48, a determination yields that the operator instruction is below the signal threshold, the control logic executes step 54 as set out above.

The signal threshold may be at a different level, and/or may be of a different type, for the alarm signal and for the operator instruction.

If, in step 48 a determination yields that the alarm signal exceeds the signal threshold, this is indicative of the proximity requirement being fulfilled by the operator instruction. If step 48 was carried out before step 46, the system proceeds to step 46.

In step 50, a distinction is made whether or not the alarm signal is from a detector alarm device or from a repeater alarm device. The distinction may be made by way of a determination by the control system. The distinction may be made by an alarm device, e.g. an alarm device may include control logic that allows it to determine whether or not it has detected an alarm condition or whether or not it acts as a repeater alarm device. The method may proceed to step 52 for repeater alarm devices even if the proximity condition is not fulfilled. Alternatively, the method may require that a proximity condition is fulfilled also for repeater alarm devices and proceed to step 52 only after steps 46 and/or 48 were completed.

If any repeater alarm devices are sounding, the interface may present a locate-alarm menu option. If only detector alarm devices are sounding, the interface may present a silence-alarm function.

If all proximity requirement are fulfilled the control system proceeds to step 52 in which silencing instructions are issued to an alarm device or server.

Although the steps are illustrated in sequence, the steps of the control method 40 may be carried out in parallel or in different order. As one example, the step 42 of listening for the presence of an alarm signal may be carried out continuously by a suitable device. The method may be initiated by step 44 (receiving an operator instruction) and the control system will then carry out step 42 to listen for an alarm signal. This may be appropriate for embodiments in which a continuous listening would be inappropriate, e.g. consuming too much power. As another example, the determination of steps 46 and 48 may be carried out at the same time. Likewise, the control system may continue to monitor for alarm signals and/or operator instructions according to steps 42 and 44 while other steps are carried out. The control system may carry out other steps corresponding to method steps set out above, such as to presentation of a status message or user instruction.

References herein to control logic are to be understood to include machine-executable instructions and imply the use of software instructions, one or more processors, memory, and the like and combinations of some or all of such components.

The proximity determination is conveniently based on the signal strength (loudness) of an alarm signal. However, a suitably configured system may utilise geolocation such as triangulation and/or GPS tracking.

The invention claimed is:

1. A control system for silencing an alarm signal from an alarm device, the control system comprising a sensor configured to receive an alarm signal from an alarm device;

an input interface configured to receive an operator instruction to silence the alarm signal; and control logic configured to issue in response to the operator instruction a silencing instruction interpretable by the alarm device as an instruction to deactivate the alarm signal, wherein the control logic is configured to receive the alarm signal from the sensor and the control logic is configured to determine whether or not the alarm signal exceeds a signal threshold indicative of the proximity of the input interface to the alarm device, and wherein the control logic includes an interlock preventing the silencing instruction from being sent for the alarm device if the signal threshold is not exceeded.

2. The control system according to claim 1, wherein the control logic is configured to classify the alarm signal based on at least one of the volume, frequency and modulation of the alarm signal.

3. The control system according to claim 1, wherein the input interface and the sensor are comprised in a handheld device or a non-handheld device.

4. The control system according to claim 1, wherein the input interface comprises a touch screen.

5. The control system according to claim 1, wherein the input interface comprises a remote control interface.

6. The control system according to claim 1, configured to present a notification when the control logic determines that the signal threshold is not exceeded by the alarm signal.

7. The control system according to claim 1, configured to present a notification when the control logic determines the presence of an alarm signal and the signal threshold is not exceeded by the alarm signal.

8. The control system according to claim 1, configured to present the silencing instruction via a wireless communication channel.

9. The control system according to claim 1, configured to present to silencing instruction to an intermediary other than the alarm device.

10. The control system according to claim 1, further comprising:

a server;

at least one alarm device in communication with the server; and a control device comprising the sensor.

11. The control system according to claim 10, wherein the control logic is configured to issue the silencing instruction to the server.

12. The control system according to claim 10, wherein the alarm device is configured to transmit an alert signal indicative that the alarm device is emitting the alarm signal.

13. The control system according to claim 12, wherein the control device is configured to receive the alert signal and on receipt thereof control the sensor to detect the alarm signal.

14. The control system according to claim 13, wherein the control device is configured to receive the alert signal from the alarm device, via the server.

15. The control system according to claim 13, wherein the sensor is configured to receive the alarm signal after or upon receipt of the alert signal by the control device.

16. The control system according to claim 10, configured to execute the control logic on the control device.

17. The control system according to claim 10, configured to execute the control logic on the server.

18. The control system according to claim 1, wherein the control logic is configured to distinguish between a detector alarm device that has detected an alarm condition and a repeater alarm device that sounds an alarm signal without having detected the alarm condition, and wherein the control logic includes a configuration allowing it to prevent a silencing instruction from being sent for a detector alarm device.

19. The control system according to claim 18, wherein the control system comprises a configuration to send a silencing instruction for the detector alarm device if the repeater alarm devices have been silenced.

20. A method of controlling the silencing of an alarm signal of an alarm device, the method comprising the steps of:

using a sensor to receive an alarm signal from the alarm device;

using an input interface to receive an operator instruction to silence the alarm signal;

providing control logic configured to receive the alarm signal from the sensor and to issue a silencing instruction to deactivate the alarm signal in response to the operator instructions;

making a determination, by the control logic, whether or not the alarm signal exceeds a signal threshold indicative of the proximity of the input interface to the alarm device; and blocking, by the control logic, the silencing instruction from being sent for the alarm device if the signal threshold is not exceeded.

21. The method according to claim 20, comprising verifying the alarm signal based on at least one of the volume, frequency and modulation of the alarm signal.

22. The method according to claim 20, comprising presenting a message when the control logic determines that the signal threshold is not exceeded by the alarm signal.

23. The method according to claim 20, comprising sending the silencing instruction via a wireless communication channel.

24. The method according to claim 20, comprising sending the silencing instruction to a device other than the alarm device, in particular to a server in communication with the alarm device.

25. The method according to claim 20, comprising distinguishing between a detector alarm device that has detected an alarm condition and a repeater alarm device that sounds an alarm signal without having detected the alarm condition, and prevent a silencing instruction from being sent for a detector alarm device.

26. The method according to claim 25, comprising sending a silencing instruction for the detector alarm device if the repeater alarm devices have been silenced.

* * * * *